US006497255B1

(12) United States Patent
Adams et al.

(10) Patent No.: US 6,497,255 B1
(45) Date of Patent: Dec. 24, 2002

(54) FLOOR PANEL FOR AIR HANDLING UNIT

(75) Inventors: John Carlisle Adams, Manchester, TN (US); Timothy Edward Ruhl, Manchester, TN (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/904,614

(22) Filed: Jul. 13, 2001

(51) Int. Cl.[7] ..... F16L 9/14

(52) U.S. Cl. ..... 138/149; 138/108; 138/155; 138/158; 138/169; 62/285; 62/288; 62/291

(58) Field of Search ..... 138/149, 155, 138/158, DIG. 4, 104, 108, 169; 62/285, 288, 291

(56) References Cited

U.S. PATENT DOCUMENTS 2,330,763 A * 9/1943 Townsend
3,095,014 A * 6/1963 Dosker
4,003,210 A * 1/1977 Bostroem ..... 138/149
4,280,536 A * 7/1981 Gnant ..... 138/149
4,798,917 A * 1/1989 Eiermann et al. ..... 138/149
4,972,759 A * 11/1990 Nelson ..... 138/149
5,219,403 A * 6/1993 Murphy ..... 138/149
5,669,230 A * 9/1997 Bruce et al. ..... 62/285
5,749,399 A * 5/1998 Reyes Zorrilla ..... 138/155
5,975,146 A * 11/1999 Lardillat et al. ..... 138/149
6,311,735 B1 * 11/2001 Small, Sr. ..... 138/158
6,405,552 B1 * 6/2002 Hubert et al. ..... 62/285

* cited by examiner

*Primary Examiner*—James Hook
(74) *Attorney, Agent, or Firm*—Wall Marjama & Bilinski LLP

(57) ABSTRACT

A floor panel for use in an air handling unit that provides a thermal barrier to the passage of heat. The panel is reinforced internally so that it can support a heavy piece of air handling equipment inside the unit such as an air conditioner heat exchanger coil. The panel includes a reservoir for collecting moisture from the coil and rapidly exhausting the moisture from the unit.

11 Claims, 6 Drawing Sheets

FLOOR PANEL FOR AIR HANDLING UNIT

FIELD OF THE INVENTION

This invention relates generally to an air handling unit, and in particular to a reinforced floor panel for use in an air handling unit that is capable of supporting a piece of heavy air handling and acts as a thermal barrier to the flow of heat into or out of the unit.

BACKGROUND OF THE INVENTION

More specifically, this invention relates to an air handling unit having modular sections each having a framework containing structural elements forming perpendicularly aligned openings rectangular openings that are closed in final assembly by panels. The panels are constructed so that they have a low thermal conductivity thereby impeding the flow of heat into and out of the unit. Seals are provided that surround the inner periphery of each panel to further prevent air from passing around the panels.

Oftentime, particularly when the air handling unit is arranged to conduct conditioned air, equipment such as heat exchanger coils used in heating and cooling system are mounted inside the unit. This type of equipment is typically rather heavy and requires that the duct work supporting the equipment be reinforced. Heretofore this reinforcing was accomplished by external braces or brackets that were generally difficult to install and which considerably added to the cost of the unit. In addition, depending whether the air is being heated or cooled, the heat exchanger coil produced a good deal of condensate which collected inside the unit. This condensate causes corrosion problems and, if allowed to stagnate, can pose a serious health hazard.

SUMMARY OF THE INVENTION

It is therefore an object of the present inventor to improve air handling units.

It is a further object of the present inventor to provide a floor panel for an air handling unit that is reinforced internally so that a piece of relatively heavy air handling equipment can be supported upon the panel.

Another object of the present invention is to efficiently remove condensate from an air handling unit that contains a heat exchanger coil.

Yet a further object of the present invention is to provide a floor panel for an air handling unit that is capable of supporting a heavy load while still forming a thermal barrier for impeding the flow of heat into or out of the unit.

These and other objects of the present invention are attained in an air handling unit that contains a framework having modular units made up of structural elements that form perpendicularly aligned rectangular shaped openings which are closed by panels having a low thermal conductivity. The panels are locked to the structural elements and sealed in place to provide an enclosed passage for conductivity air. A high strength self contained floor panel is contained in one of the modular sections for supporting a piece of air handling equipment within the unit. The floor panel provides a thermal barrier to the passage of heat and is arranged to collect and efficiently remove condensate from inside the unit that might be generated by the internally stored equipment.

BRIEF DESCRIPTION OF THE DRAWINGS

For a better understanding of these and objects of the invention, reference will be made to the following detailed description of the invention which is to be read in association with the accompanying drawing, wherein.

DETAILED DESCRIPTION OF THE INVENTION

Figure 1:
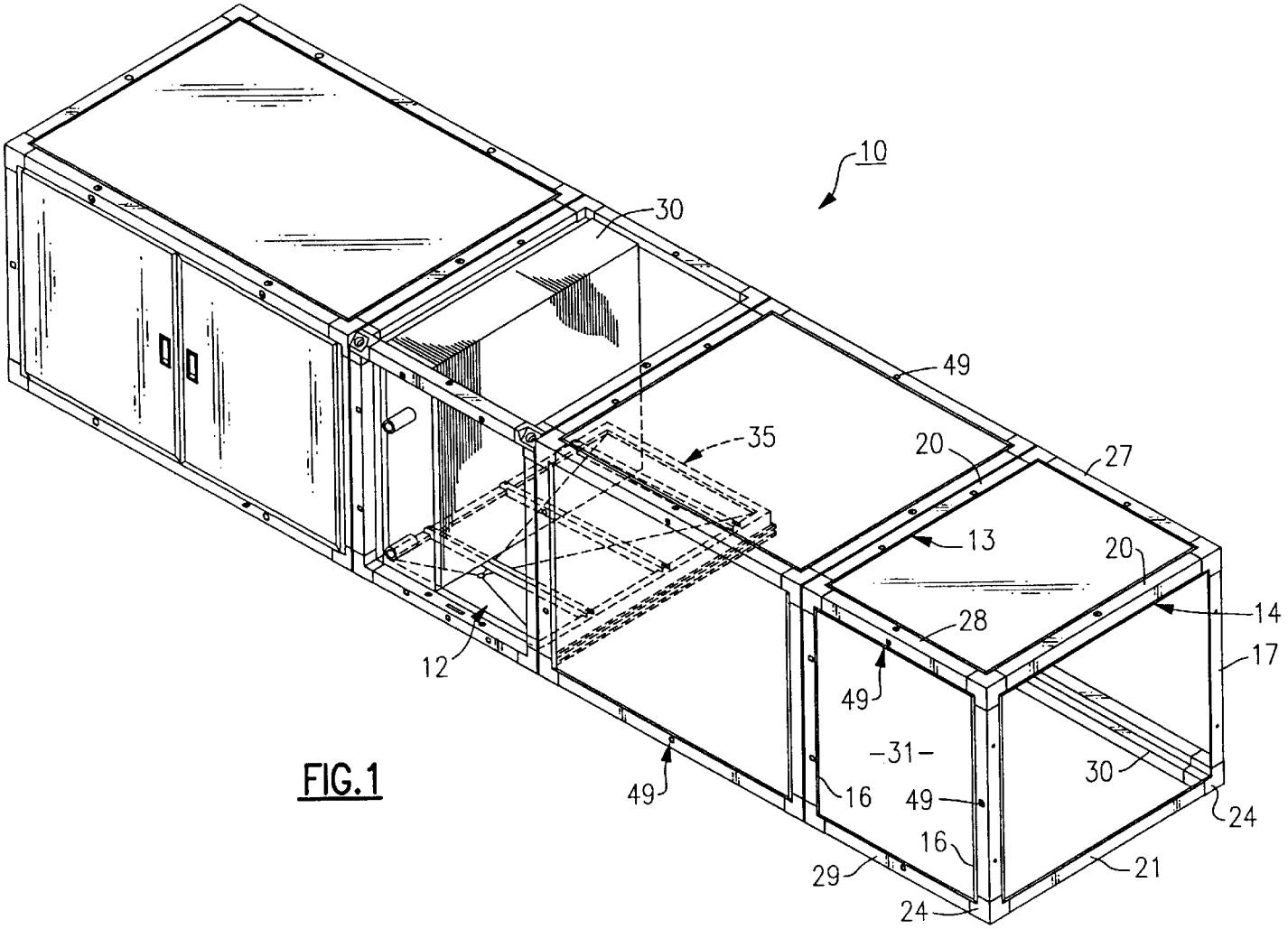
FIG. 1 is a perspective view illustrates a portion of an air handling unit with parts removed to show a heat exchanger coil mounted in one of the modular sections of the unit.
Figure 2:
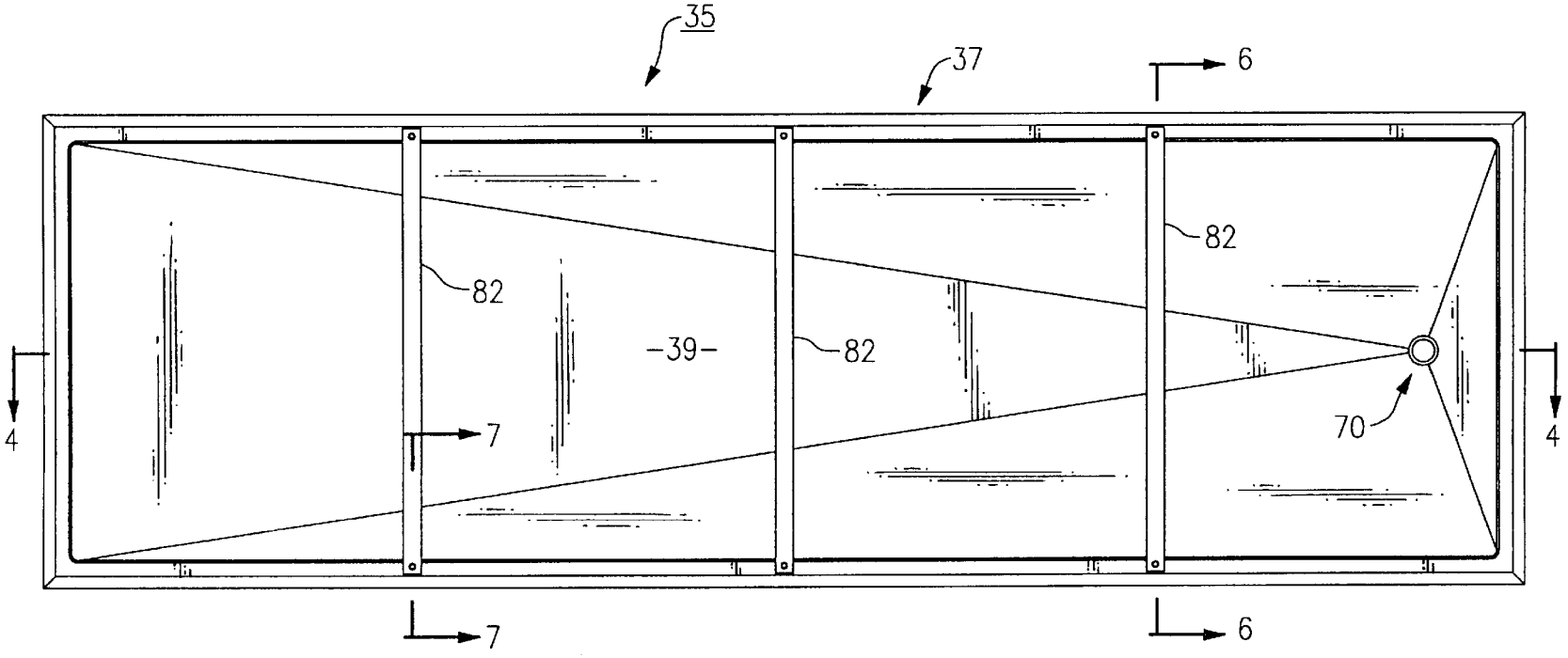
FIG. 2 is an enlarged top view showing a reinforced floor panel that is mounted beneath the heat exchanger coil.
Figure 3:
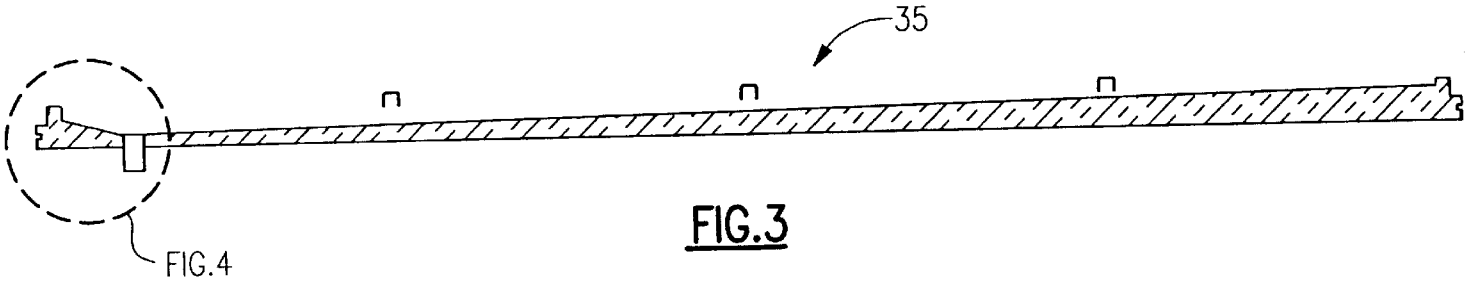
FIG. 3 is a sectional view taken along line 3–3 in FIG. 2.
Figure 4:
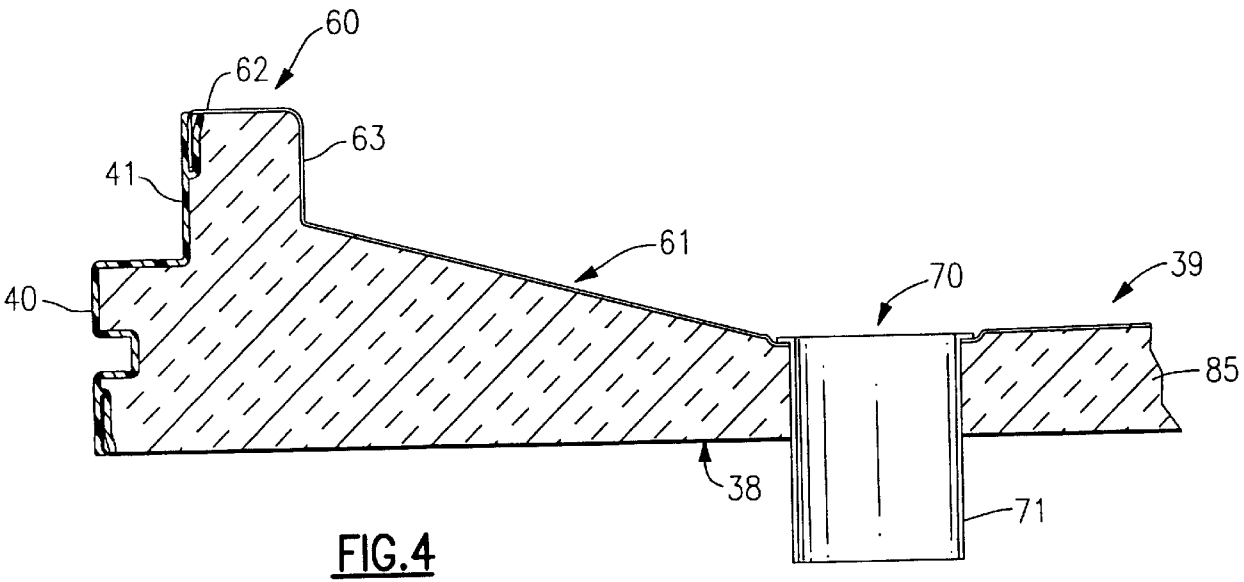
FIG. 4 is an enlarged partial view in section showing a drain mounted in the floor panel illustrated in FIG. 3.

Referring initially to FIG. 1, there is illustrated a portion of an air handling unit generally referenced 10 that embodies a floor panel embodying the teachings of the present invention. The air handling unit is fabricated of modular sections that are brought together to establish a rectangular shaped duct work that is arranged to conduct air along a desired path of travel. Each section includes a pair of spaced apart rectangular end frames 13 and 14 that include opposed vertical rails 16 and 17 and opposed top and bottom rails 20 and 21. The rails are interconnected by corner pieces 24. The two end frames of each section are further connected at the corner pieces by horizontally disposed beams that include a pair of upper beams 27 and 28 and a pair of horizontal lower beams 29 and 30. The rails and beams will be jointly referred to herein as structural elements.

The structural elements contained in each section are fabricated of rectangular metal tubes that are slidably retained in the corner pieces. Each of the sections thus formed has perpendicularly aligned rectangular shaped openings which are closed in assembly by means of specially constructed panels, such as panel 31, which form thermal barriers to impede the flow of heat into or out of the unit. Appropriate seals (not shown) are provided along the inside of the structural elements that seal against the periphery of each panel to prevent air from passing between the panels and the framework of each section. The panels are locked in assembly by a series of latches contained in the structural elements that are arranged to engage recesses formed in the panels to urge the panels into compressing contact with the peripheral seals.

The corner pieces and the seals utilized in the unit are all fabricated of a material, that has a low thermal conductivity, that is, a thermal conductivity that is considerably lower than that of the metal structural elements. Preferably these components are molded or extruded from any suitable plastics having a low thermal conductivity.

As illustrated in FIG. 1, an air conditioning heat exchanger coil 30 is mounted within one of the air handling unit modular sections 12. Depending on whether the unit is providing cooling or heating to a comfort area, the coil can produce condensate that will be disposed upon the floor panel immediately beneath the coil. The floor panel of the present invention is designed to both support the additional weight of the coil and collect and rapidly remove the moisture from the unit, as well as providing a thermal barrier to impede the flow of heat into and out of the unit.

As further illustrated in FIGS. 2–7, a floor panel 35 is mounted beneath the coil that includes a rectangular shaped frame 37 that is closed by a bottom cover 38 and top cover 39. Preferably the covers are fabricated of sheet metal that is stamped or drawn to a desired shape. The four sides of the frame are of similar construction and include a lower vertical wall section 40 and an upper vertical wall section 41. The upper wall section of each side is offset inwardly from the lower wall section and the two sections are integrally connected by a horizontal shoulder 44. The vertical height of the wall sections are about equal. An inwardly directed recess 45 is contained in the lower wall section which surrounds the panel frame. A series of latching mechanisms 49 are mounted in the structural elements surrounding the floor panel. Each mechanism has a latching arm that is arranged to move into engagement with the recess in the frame and urge the panel into compressing against the peripheral seals when the panel is latched in assembly.

The top edge of the upper frame wall section and the bottom edge of the lower frame wall section are equipped with elongated vertical members 51 and 52, respectively, that are integral with the wall sections. The members coact with the wall sections to establish slots 53 that surround the entire upper and lower perimeters of the panel frame. The top and bottom covers are both provided with inwardly turned skirts 56 that are received within the slots in assembly to totally enclose the panel and create an internal cavity 58 therein.

The top cover 39 of the panel includes an outer rim section 60 and a center section 61 that is integrally formed with the rim section. The rim section includes a horizontal top wall 62 and a vertical side wall 63 (FIG. 7) that extend downwardly a short distance from the top wall to define the perimeter of a reservoir 65 for collecting moisture. The floor 67 of the reservoir inclines downwardly toward a drain 70. The drain contains a plastic pipe 71 that is bonded to the floor of the reservoir to create a leak-tight joint therebetween. The pipe passes downwardly through the floor panel (FIG. 6) and has sufficient capacity to rapidly remove any moisture that is collected within the reservoir. Preferably, all the sections of the top cover are integrally formed from a single sheet of metal.

Figure 5:
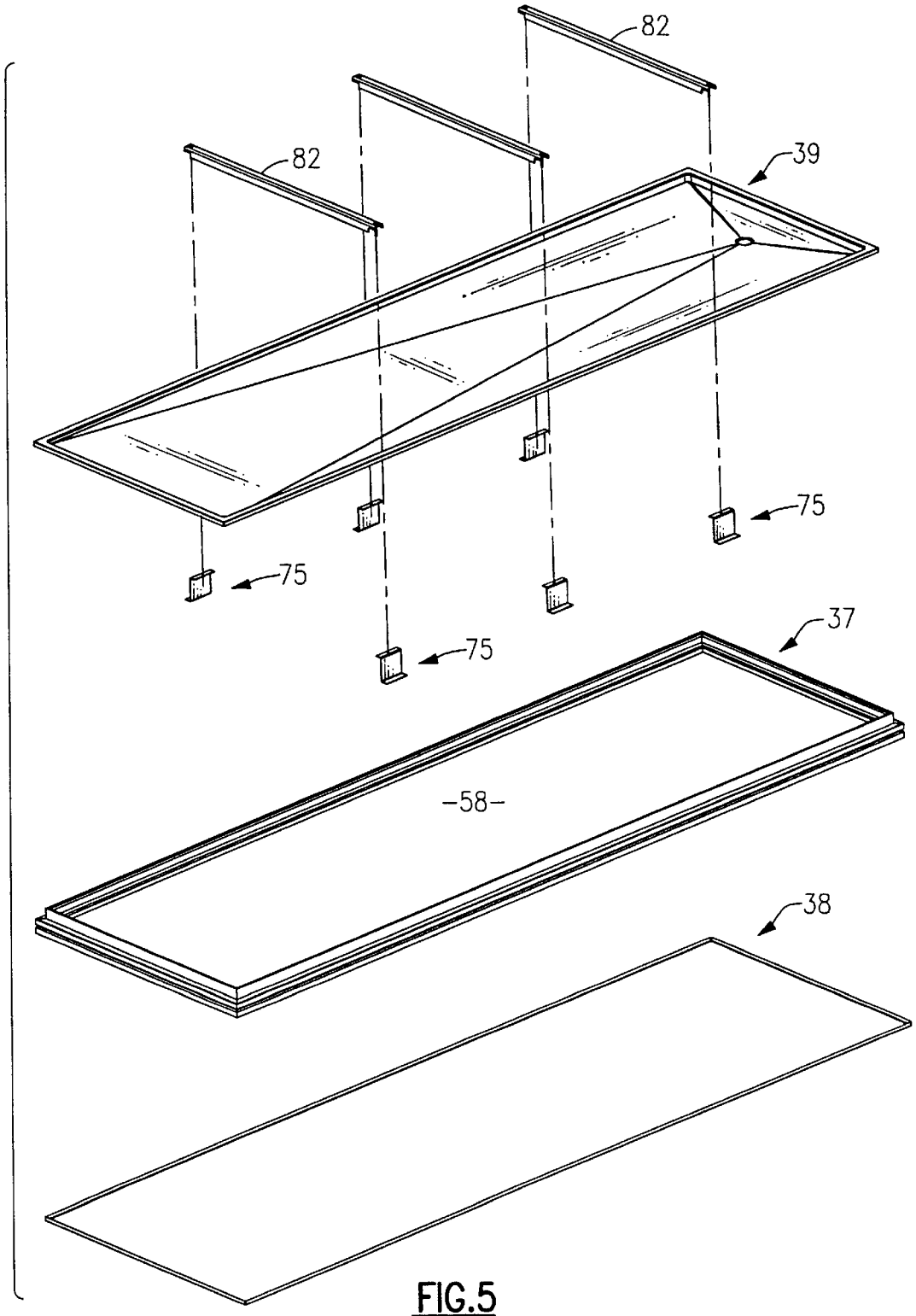
FIG. 5 is an exploded view of the floor panel.
Figure 6:
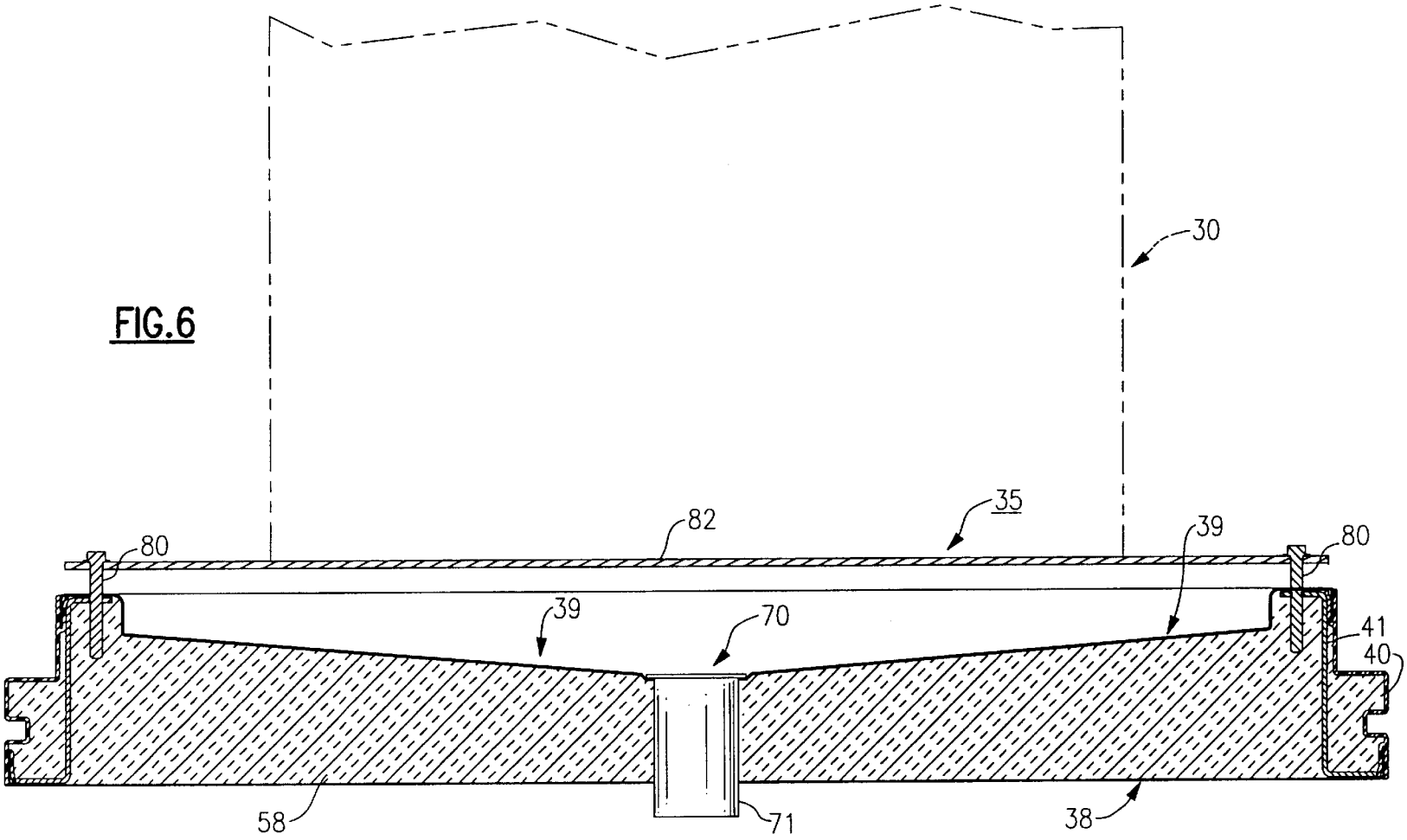
FIG. 6 is an enlarged sectional view taken along lines 6—6 in FIG. 2.
Figure 7:
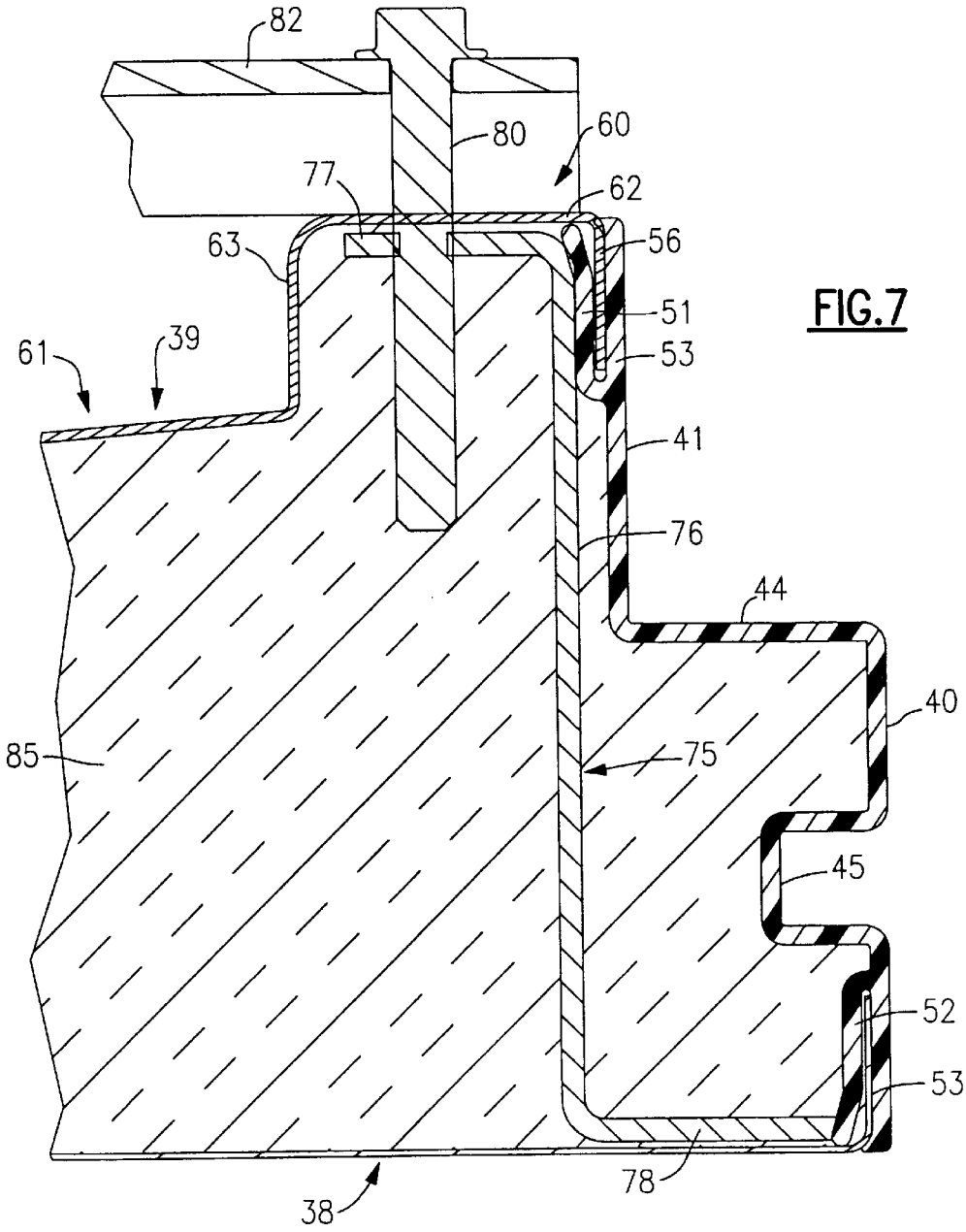
FIG. 7 is a further enlarged sectional view taken along lines 7—7 in FIG. 2.

As best illustrated in FIGS. 5 and 6, a series of reinforcing members, generally referenced 75, are mounted inside the cavity of the floor panel and are stationed at predetermined intervals along the length or the width of the panel. Each reinforcing member is a Z-shaped element formed from a single piece of high strength material such as metal or plastic capable of supporting a relatively heavy load. Each element includes a vertical web 76 and a pair of horizontal flanges that include an upper flange 77 and a lower flange 78. In assembly, the upper flange is placed beneath the top wall of the top cover rim section and the lower flange is placed directly above the lower cover in the space beneath the shoulder of the frame. The flanges are preferably mounted in direct contact with the cover surfaces.

A vertically disposed stanchion 80 is passed downwardly through a suitable opening in the top wall of the rim section and the top flange of each reinforcing member. The stanchion is secured to the top flange of the reinforcing member so that it is held in an upright vertical position in the panel. The stanchions extend upwardly to a given height above the rim of the upper cover and downwardly some distance below the top flange of the reinforcing member. The entire panel cavity is filled completely with a curable material, such as a foam polyurethane 85, which, when cured, serves to bond all the panel components together in final assembly. Preferably the stanchions, like the reinforcing members, are fabricated of a high strength metal.

The reinforcing members are aligned in pairs along the panel and the stanchions in each pair are connected by a horizontal beam 82. The beams are secured to the raised ends of the aligned stanchions by any suitable means as known and used in the art. The beams all lie in a common plane and combine, in assembly, to provide a platform upon which the heat exchanger 30 is supported inside of the air handling unit.

As should be now evident, the floor panel of the present invention is internally reinforced so that the weight of the heat exchanger is transferred onto the structural elements of the unit framework thus eliminating the need for the construction of external brackets or the like. This provides for ease of construction, while at the same time reduces the unit cost. The floor panel, like the other wall panels of the air handling unit provides a strong thermal barrier thus insuring the thermal integrity of the unit. In addition, the floor panel can collect moisture from the heat exchanger coil and rapidly remove this moisture from the unit. Although this invention has been described with specific reference to providing support to a heat exchanger coil, the panel can be adapted to accommodate other types of equipment generally associated with this type of air handling unit.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. In an air handling unit that contains a framework having rectangular shaped openings that are closed by panels that are latched into the openings to provide an enclosed channel for conducting air, a floor panel for use in said unit for supporting equipment mounted inside said unit that includes a rectangular frame having vertically disposed sides, a lower and an upper cover connected to said frame for closing the panel and establishing an internal cavity therein, said upper cover having a horizontally disposed rim section surrounding the periphery of said cover and a center section integral with the rim section that inclines downwardly from the rim section to a drain means for removing moisture from said unit, a series of support members mounted about the panel at spaced apart intervals, each member includes a vertical web extending between the lower cover and the rim of the upper cover and a horizontal upper flange depending from the web that is mounted in supporting contact against the rim of the upper cover, and a settable foam material completely filling said internal cavity which, when set, bonds the covers, the frame and the support members together into a single unit in assembly.

2. The floor panel of claim 1 wherein each side of the frame has a first vertical lower wall that is joined to an inwardly offset second vertical upper wall by a horizontal shoulder.

3. The floor panel of claim 2 wherein said support members are Z-shaped elements wherein the web of the member is mounted adjacent to the second upper wall of the frame and further includes a horizontally disposed lower flange that is integral with the web and is supported in contact against the lower cover.

4. The floor panel of claim 3 wherein the lower side walls of the panel contains an inwardly disposed recess whereby the recesses can be engaged by a latching mechanisms for securing the panel within an opening in the framework.

5. The floor panel of claim 3 wherein the support members are aligned in opposing pairs along the length of the panel.

6. The floor panel of claim 5 that further includes a vertical stanchion anchored in the upper flange of each support member that passes upwardly to a given height and cross members extending across the top of the panel between the stanchions in each pair and means for securing each cross member to the opposed stanchions in each pair so that the cross members lie in a common plane.

7. The floor panel of claim 6 wherein a heat exchanger coil is supported upon the cross members.

8. The floor panel of claim 1 wherein each cover has a vertical skirt depending from the peripheral edges of the covers and said frame has elongated slots located along the upper and lower edges of each side for receiving said skirts therein.

9. The floor panel of claim 1 wherein said covers are formed of metal and the frame is formed of a plastic having a low thermal conductivity that is less than that of the covers.

10. The floor panel of claim 9 wherein said foam is a polyurethane having a thermal conductivity less than that of the covers.

11. The floor panel of claim 1 wherein said drain includes a plastic tube that passes downwardly through the lower cover.

* * * * *